United States Patent [19]

Bodine

[11] 4,429,743

[45] Feb. 7, 1984

[54] WELL SERVICING SYSTEM EMPLOYING SONIC ENERGY TRANSMITTED DOWN THE PIPE STRING

[76] Inventor: Albert G. Bodine, 7877 Woodley Ave., Van Nuys, Calif. 91406

[21] Appl. No.: 344,626

[22] Filed: Feb. 1, 1982

[51] Int. Cl.[3] ..... E21B 37/08; E21B 41/00

[52] U.S. Cl. ..... 166/177; 267/125; 248/610; 166/249

[58] Field of Search ..... 166/77, 177, 249, 286, 166/301; 248/613, 562, 631, 610; 175/55; 173/49; 267/122, 125

[56] References Cited

U.S. PATENT DOCUMENTS

| | | | |
|---|---|---|---|
| 2,942,849 | 6/1960 | Bodine | 173/49 X |
| 2,976,930 | 3/1961 | Marquis et al. | 267/125 |
| 3,130,552 | 4/1964 | Bodine | 166/286 X |
| 3,160,111 | 12/1964 | Berry | 267/125 |

*Primary Examiner*—Stephen J. Novosad
*Assistant Examiner*—Michael Starinsky

[57] ABSTRACT

A well servicing system in which sonic energy is transmitted down a pipe string to a down hole work area a substantial distance below the surface. The sonic energy is generated by an orbiting mass oscillator and coupled therefrom to a central stem to which the piston of a cylinder-piston assembly is connected. The cylinder is suspended from a suitable suspension means such as a derrick, with the pipe string being suspended from the cylinder in an in-line relationship therewith. The fluid in the cylinder affords compliant loading for the piston while the fluid provides sufficiently high pressure to handle the load of the pipe string and any pulling force thereon. The sonic energy is coupled to the pipe string in a longitudinal vibration mode which tends to maintain this energy along the string.

8 Claims, 11 Drawing Figures

WELL SERVICING SYSTEM EMPLOYING SONIC ENERGY TRANSMITTED DOWN THE PIPE STRING

This invention relates to well servicing operations wherein sonic energy is transmitted down a pipe string, and more particularly to such a system wherein energy transmission losses are minimized.

There are a number of well servicing operations, particularly in the case of oil wells, where sonic energy is transmitted down a pipe string for use to perform installation, extraction and other work operations. Included among such operations are gravel packing, liner extraction, perforation cleaning, liquid treatment, etc. Particularly in situations involving deep wells, the sonic energy must be transmitted through a long and heavy string of conventional drill pipes, which causes an appreciable attenuation or loss of sonic energy by the time it reaches the down hole work area. In such a situation, it is therefore important that energy losses in the transmission system be minimized.

Typical prior art systems involving the transmission of sonic energy down drill pipe strings, particularly for extracting oil well liners and the like, are described in my U.S. Pat. Nos. 2,972,380 and 4,236,580, and in Pat. No. 3,399,724 issued to W. B. Brooks. In all of these prior art patents, the sonic energy is transmitted down a relatively long drill pipe string to the work area.

The system of the present invention provides an improved system which more effectively couples the sonic energy available from an orbiting mass oscillator into the top of a drill pipe string. Means are provided in this system to minimize the loss of sonic energy into the derrick and suspension system at the top of the drill string, at the same time enabling the suspension of a very heavy pipe string while applying a large pulling force on this string. Efficient coupling of the sonic energy generated by the orbiting mass oscillator is assured by the provision of a low acoustical impedance to the output of this oscillator at the upper end of the drill string. Further, an acoustical resonator may be connected to the top end of the drill pipe string which further contributes to provide a low impedance to the output of the sonic oscillator where it is coupled to the string. The ability to handle high drill string suspension and pulling loads is achieved by means of a cylinder-piston assembly which has high fluid pressurization. The cylinder-piston assembly is effectively cushioned by means of the high pressure fluid which provides the needed compliance. This compliance also may form a resonant acoustical circuit at the frequency of the sonic energy with the mass of a column of cylinder fluid coupled thereto, this resonant circuit affording a low impedance environment for coupling the sonic energy to the top of the drill string. It is further to be noted that the use of an in line cylinder-piston assembly enables the pull force from the derrick to be applied on a straight line to the top of the drill pipe string, the cylinder being located in a straight line between the pipe and the derrick. This makes for a stable high capacity pulling system which is light weight and not prone to induce unwanted lateral sonic vibration modes to the pipe string.

It has been found most helpful in analyzing the device of this invention to analogize the acoustically vibrating circuit utilized to an equivalent electrical circuit. This sort of approach to analysis is well known to those skilled in the art and is described, for example, in Chapter 2 of "Sonics" by Hueter and Bolt, published in 1955 by John Wiley and Sons. In making such an analogy, force F is equated with electrical voltage E, velocity of vibration u is equated with electrical current i, mechanical compliance $C_m$ is equated with electrical capacitance C, mass M is equated with electrical inductance L, mechanical resistance (friction) $R_m$ is equated with electrical impedance $Z_e$.

Thus, it can be shown that if a member is elastically vibrated by means of an acoustical sinusoidal force $F_o \sin \omega t$ ($\omega$ being equal to $2\pi$ times the frequency of vibration), that $$Z_m = R_m + j\left(\omega M - \frac{1}{\omega C_m}\right) \tag{1}$$

Where $\omega M$ is equal to $1/\omega C_m$, a resonant condition exists, and the effective mechanical impedance $Z_m$ is at a minimum and is equal to the mechanical resistance $R_m$, the reactive components $\omega M$ and $1/\omega C_m$ cancelling each other out. Under such a resonant condition, velocity of vibration is at a maximum, power factor is unity, and energy is more efficiently delivered to a load to which the resonant system may be coupled.

It is important to note the significance of the attainment of high acoustical "Q" in the resonant system being driven to increase the efficiency of the vibration thereof and to provide a maximum amount of power. As for an equivalent electrical circuit, the "Q" of an acoustically vibrating system is defined as the sharpness of resonance thereof and is indicative of the ratio of the energy stored in each vibration cycle to the energy used in each such cycle. "Q" is mathematically equated to the ratio between $\omega M$ and $R_m$. Thus, the effective "Q" of the vibrating system can be maximized to make for highly efficient, high-amplitude vibration by minimizing the effect of friction in the system and/or maximizing the effect of mass in such system.

In considering the significance of the parameters described in connection with equation (1), it should be kept in mind that the total effective resistance, mass, and compliance in the acoustically vibrating system are represented in the equation and that these parameters may be distributed throughout the system rather than being lumped in any one component or portion thereof.

It is also to be noted that orbiting mass oscillators are utilized in the implementation of the invention that automatically adjust their output frequency and phase to maintain resonance with changes in the characteristics of the load. Thus, in the face of changes in the effective mass and compliance presented by the load with changes in the conditions of the work material as it is sonically excited, the system automatically is maintained in optimum resonant operation by virtue of the "lock-in" characteristics of the applicant's unique orbiting mass oscillators. Furthermore, in this connection the orbiting mass oscillator automatically changes not only its frequency but its phase angle and therefore its power factor with changes in the resistive impedance load, to assure optimum efficiency of operation at all times. The vibrational output from such orbiting mass oscillators also tends to be constrained by the resonator to be generated along a controlled predetermined coherent path to provide maximum output along a desired axis.

In brief, the system of the invention is as follows. Sonic energy generated by means of an orbiting mass oscillator comprising pairs of eccentrically weighted rotor members which are rotated in opposite directions, is coupled to a central stem to which the piston of a piston cylinder assembly is connected, this piston being of relatively light weight and relatively small diameter The cylinder casing is suspended from above, in an in-line relationship with a pipe string suspended therefrom, from suitable suspension means, such as a derrick. The fluid in the cylinder is highly pressurized. The high pressure fluid affords compliant tuning for the piston, but at the same time provides sufficiently high pressure to handle the load of the pipe string as well as any pulling force that may be exerted thereon by the derrick.

In one embodiment of the invention, the compliance of the gas in an accumulator forms a Helmholtz-type resonator when used with the mass of the oil column in the connecting conduit to a hydraulic cylinder, this resonating effect at the frequency of the sonic energy generated by the oscillator affording an optimum low impedance environment for coupling the sonic energy to the top end termination of the pipe string. The balanced sonic impulses generated by the oppositely rotating oscillator rotors are delivered directly to the central stem of the system and coupled to the pipe string in a longitudinal vibrational mode which tends to maintain all of the energy along the pipe string. The compact structure of the hydraulic compliant cylinder member provides a minimum vibrating mass effect which affords low mass and compliant reactance at the top of the pipe string. This enables efficient impedance matching to the small diameter pipe strings used for servicing in the crowded conditions encountered in relatively narrow and deep wells used in modern day systems.

It is therefore an object of this invention to provide an improved well servicing system for efficiently transmitting sonic energy down a drill pipe string.

It is a further object of this invention to minimize acoustical energy losses in the coupling and transmission system of a sonic well servicing system.

It is still a further object of this invention to increase the available amount of sonic energy available for transmission down drill strings.

Other objects of this invention will become apparent as the description proceeds in connection with the accompanying drawings, of which:

Referring now to the figures, hydraulic cylinder 30 is suspended by means of hook links 34 from a derrick (not shown) or other suitable lifting and lowering mechanism. The cylinder is suspended on the hook links at the head portion 30*a* thereof by means of post portions 30*b* which extend outwardly from the cylinder head. The links are retained on the post by means of retainer members 46 and retainer pins 41.

Figure 3:
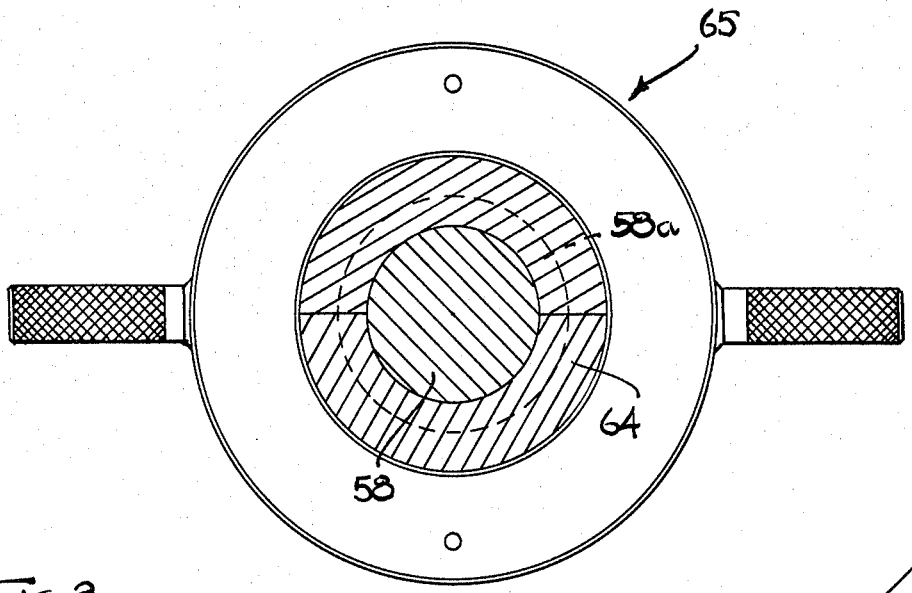
FIG. 3 is a cross-sectional view taken along the plane indicated by 3—3 in FIG. 1.
Figure 5:
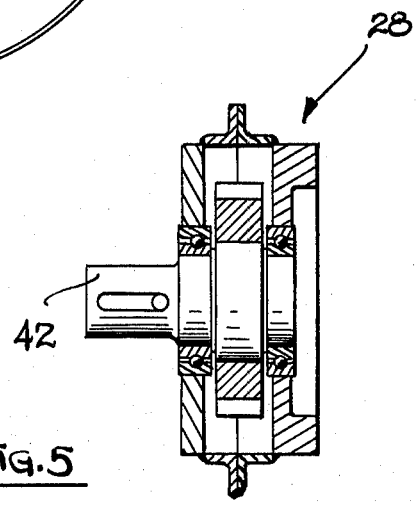
FIG. 5 is a cross-sectional view taken along the plane indicated by 5—5 in FIG. 4.
Figure 4:
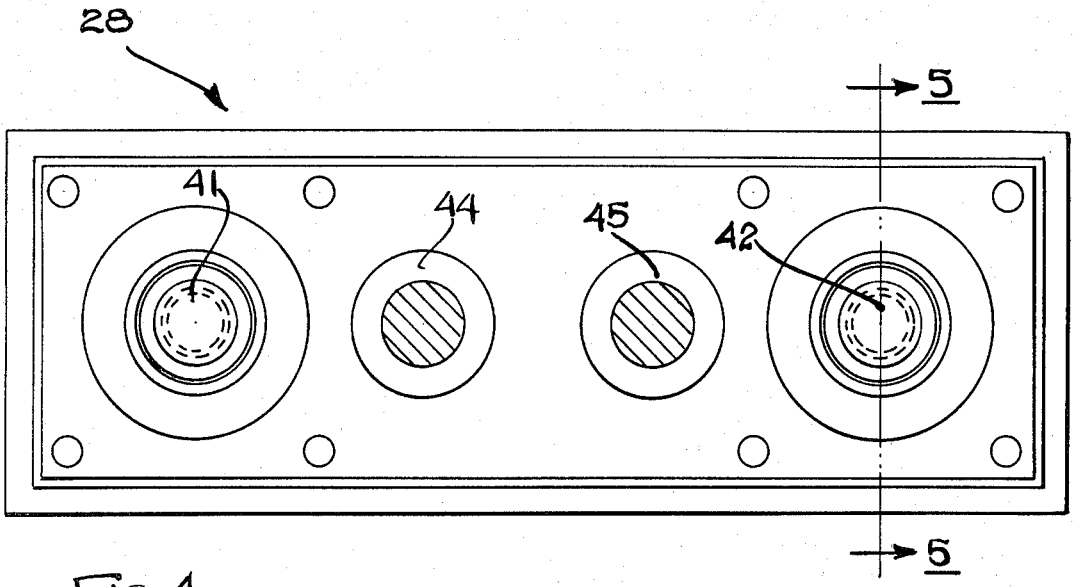
FIG. 4 is a cross-sectional view taken along the plane indicated by 4—4 in FIG. 1.
Figure 6:
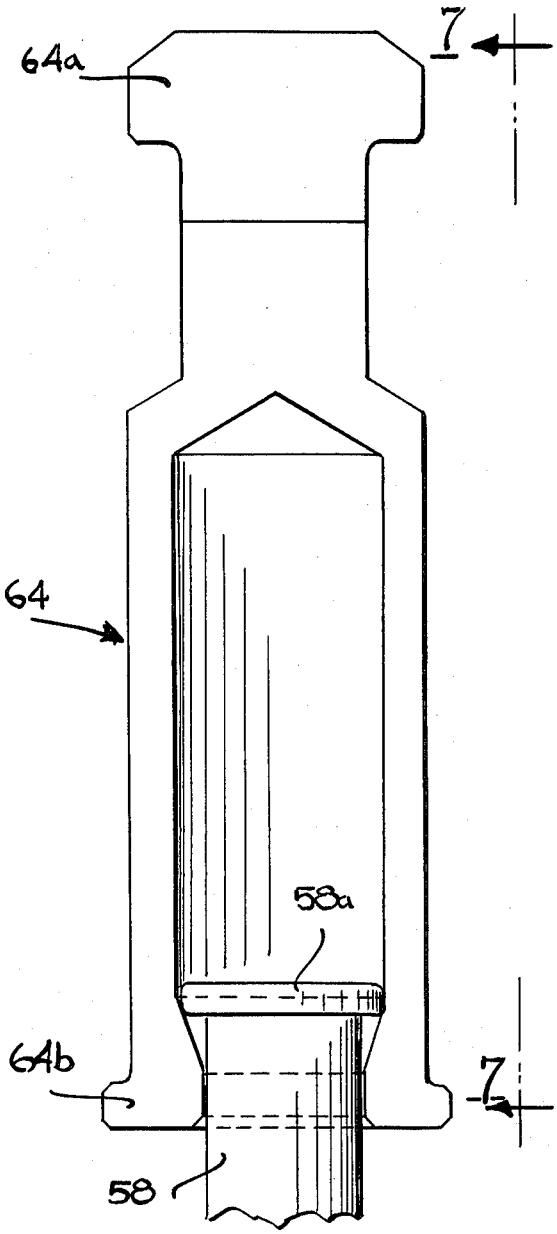
FIG. 6 is an elevational view of the clamp jaw employed in the illustrative embodiment.
Figure 7:
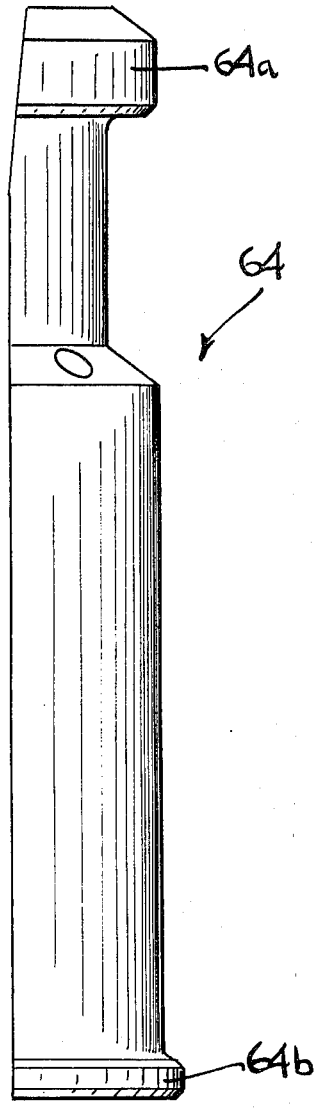
FIG. 7 is a view taken along the plane indicated by 7—7 in FIG. 6.
Figure 8:
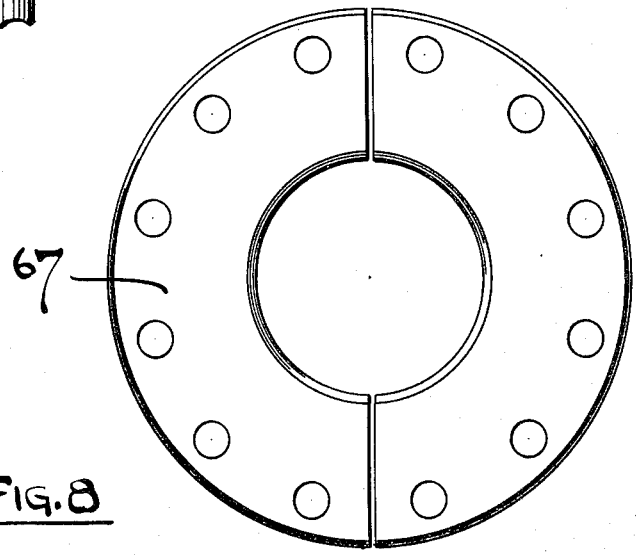
FIG. 8 is a cross-sectional view taken along the plane indicated by 8—8 in FIG. 1.

Piston rod 32 is fixedly attached to tubular stem member 36, the opposite end of this stem member having a flange 36*a* thereon. Clamping jaws 64 which are shown in detail in FIGS. 6 and 7 have similar half sections which are joined together and retain the head portions 64*a* of the jaws by means of flange plate 67. As can be seen in FIG. 8, flange plate 67 is made in two half sections which are fitted under the head portion 64*a* of the jaws. Flange plate 67 is attached to flange 36*a* by means of bolts and nuts 37. The jaws 64 are joined to the top end of the pipe string 58 by means of jaw lock member 65, which can best be seen in FIG. 3. The jaw lock member 65 is placed over the clamp jaws, and with the lip 58*a* at the top end of pipe string 58 between the jaws, the jaw lock is moved downwardly until it seats against lip portion 64*b* formed on the bottom end of the jaws to clamp lip 58*a* between the jaws. Orbiting mass oscillator assembly 16 has two pairs of eccentric rotors 18*a*, 18*b*, and 19*a*, 19*b*. Rotors 18*a* and 19*a* are driven in phase with each other in one direction, while rotors 18*b* and 19*b* are driven together in an opposite direction, also in phase with each other and in 180° phase relationship with the other pair of rotors. Rotors 18*a* and 19*a* are driven through a first U-joint assembly 40, while rotors 18*b* and 19*b* are driven through a second similar U-join assembly (not shown). The U-joints are coupled to a phasing gear box 28, which can best be seen in FIGS. 4 and 5, the gear box being driven by a pair of hydraulic motors 25. Thus, each of the U-joint drive assemblies is respectively driven by a corresponding one of shaft drives 41 and 42. Idler gears 44 and 45, which are geared to drive shafts 41 and 42 and to each other, assure that the drive shafts maintain the proper phase relationship with each other. The frame 20 of oscillator 16 is tightly coupled to stem member 36 by means of bolts 17, such that the sonic energy generated with the rotation of rotors 18*a*, 18*b*, 19*a* and 19*b* is transmitted directly to the stem from the oscillator and thence through clamping jaws 64 to the top end of the drill string 58. The frequency of the oscillator may be adjusted to provide resonant standing wave vibration of the pipe string with the resultant high level sonic energy afforded thereby.

Hydraulic motors 25 are pivotally supported by means of support strut 35 on the cylinder head portion 30*a*, such pivotal support being attained by means of hing pin 95. As can be seen, the structure of the invention is such that suspension and pulling force applied through links 34 is applied to the pipe string 58 in a straight line through 32 and 36 and is not dissipated throughout the surrounding support structure. A large frame 62 is provided around the upper structure mainly to protect the structure from damage and for use in supporting accumulators 21*a* and 21*b*, this structure not being attached or otherwise connected to the oscillator, stem or drill string.

Figure 1:
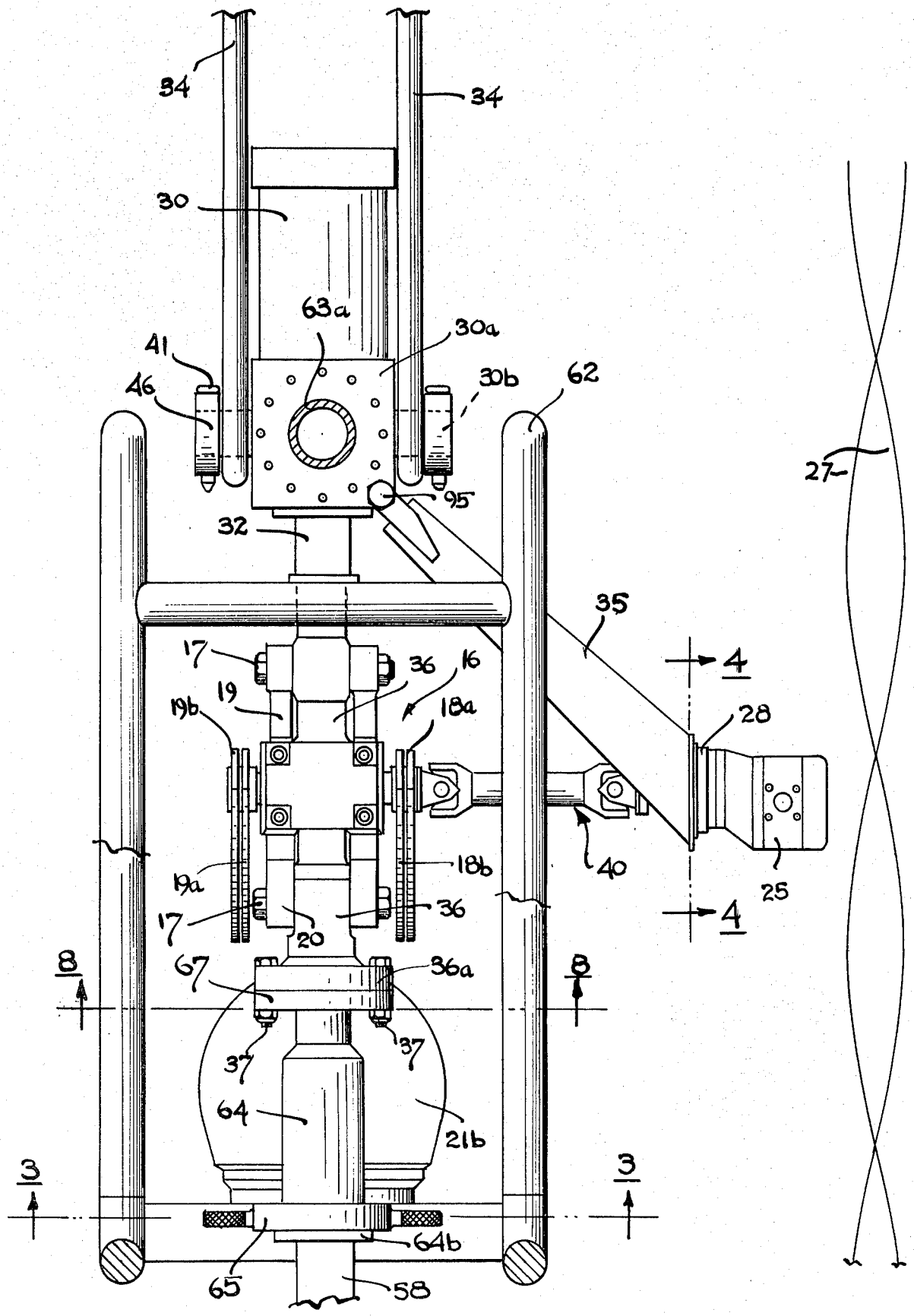
FIG. 1 is a side elevational view with partial section cut away of a first embodiment of the invention.
Figure 2:
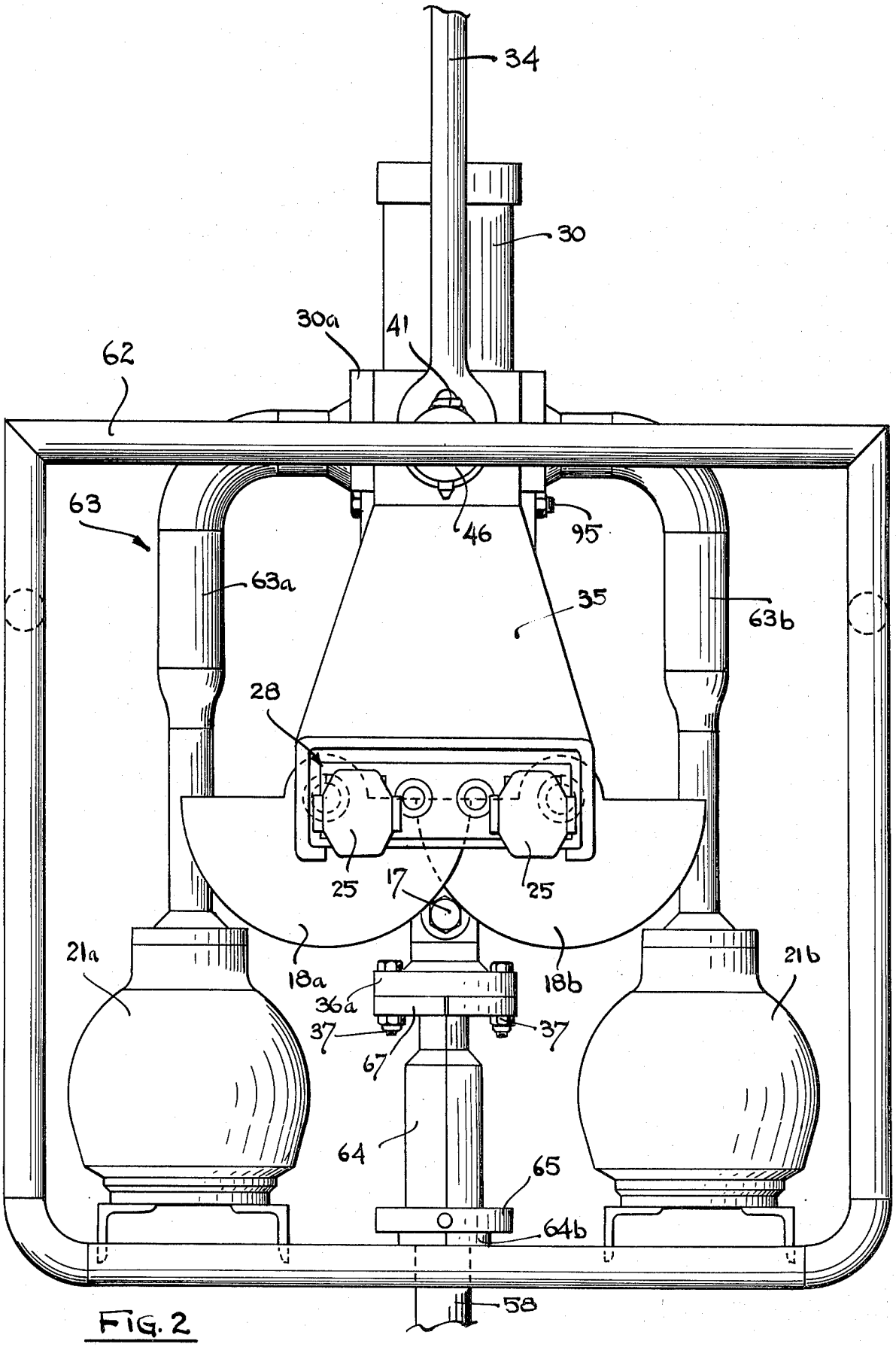
FIG. 2 is a front elevational view of said embodiment.

A particularly unique feature of the present invention is the structure associated with cylinder 30 which provides a hydraulic spring for the suspension system, this cylinder being of very compact proportions and being arranged in linear relationship between the suspension links 34 and the stem 36. Cylinder head 30*a* is connected through conduits 63*a* and 63*b* to pneumatic accumulator chambers 21*a* and 21*b*, each of which has a floating diaphragm therein through which the pneumatic force of the gas in the accumulator chambers is coupled to the liquid columns in conduits 63*a* and 63*b* respectively. The dimension of the conduits and of the pneumatic accumulators are chosen to form a Helmholtz resonator at the frequency of the output of the oscillator, thereby setting up a standing wave pattern as indicated by graph line 27 in FIG. 1, this, as can be seen, providing a low impedance as seen at the top end of the pipe string by the sonic energy fed thereto.

Figure 9:
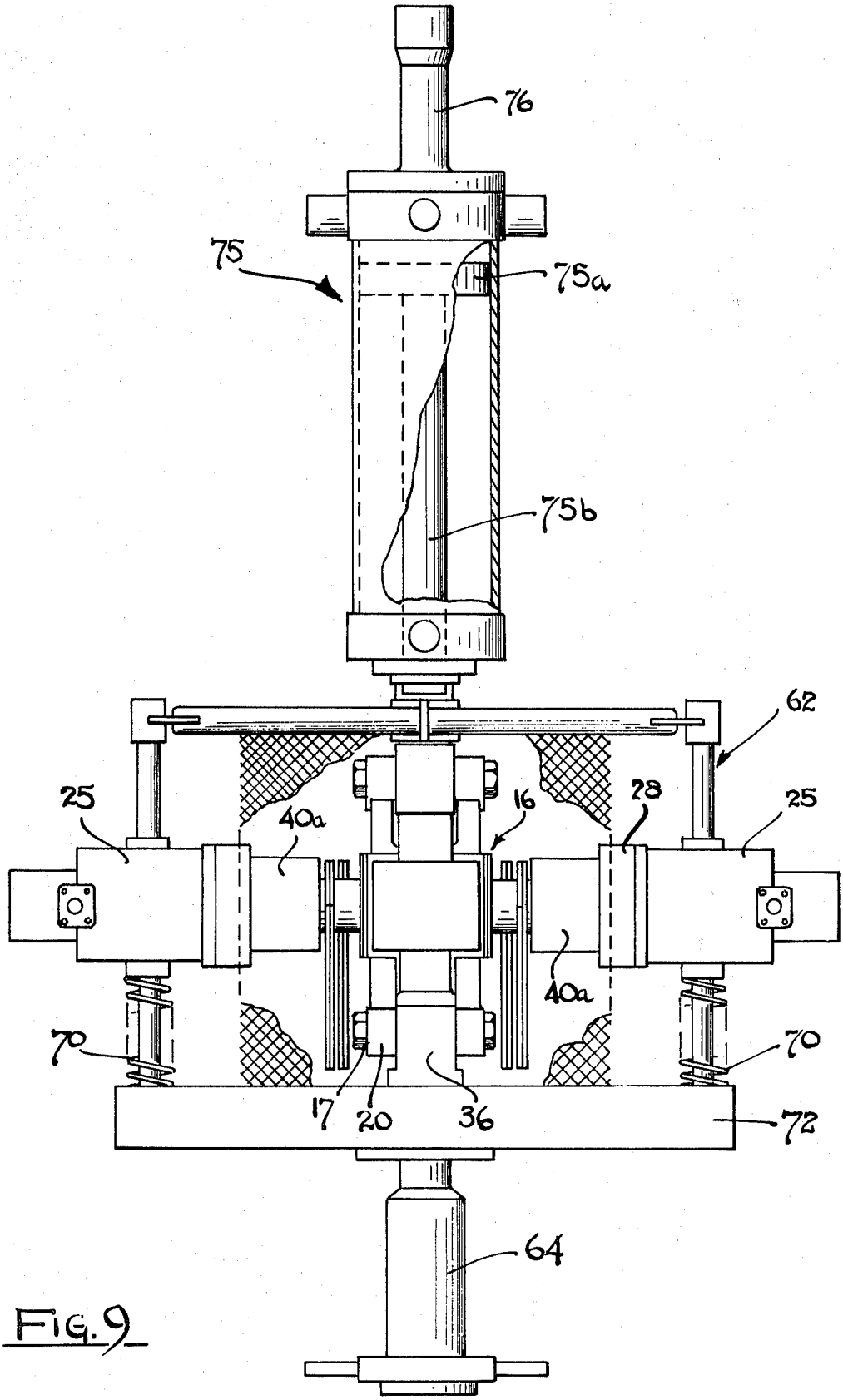
FIG. 9 is a side elevational view of a second embodiment of the invention.
Figure 10:
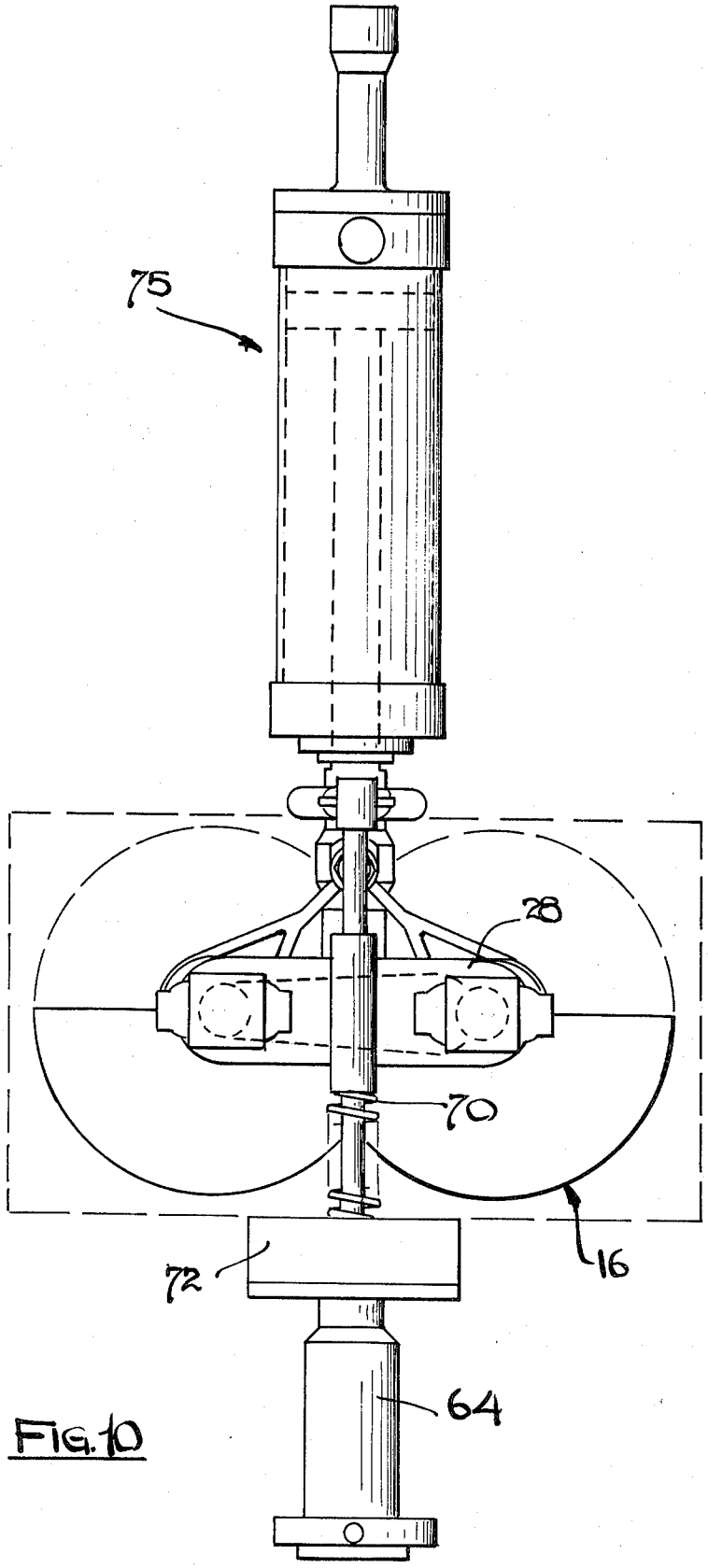
FIG. 10 is an end elevational view of the second embodiment.

Referring now to FIGS. 9 and 10, a second embodiment of the invention is illustrated. In this second embodiment, rather than employing the Helmholtz resonator for achieving low impedance coupling to the pipe string, this end result is rather achieved by employing a vertically elongated gas accumulator chamber to form a compliant high pressure air spring, as now to be described. In this second embodiment, the same numerals will be utilized to identify like components to those of the first embodiment.

An oscillator 16, similar to that of the first embodiment, is employed, the frame 20 of this oscillator being tightly coupled to stem 36 by means of bolts 17. Also, as for the first embodiment, stem 36 is clamped to the top end of the drill string (not shown) by means of clamping jaws 64. Hydraulic motors 25 are coupled to the oscillator 16 through gear box 28 by means of Schmidt-type disc couplings 40*a*. The hydraulic motors are supported on base member 72 on spring mounts 70. The device thus far described is basically the same as that of the first embodiment except for minor structural variations. In lieu, however, of the pneumatic accumulator and hydraulic spring arrangement of the first embodiment, a simpler, more compact air spring structure is employed for achieving the desired low impedance coupling. Support shaft 76 is suspended from a derrick or the like (not shown) as in the previous embodiment. Shaft 76 is fixedly attached to air spring cylinder 75, this cylinder having compressed gas therein (typically nitrogen or air). Slidably mounted in cylinder 75 is a piston 75*a* which is carried by the top end of elongated piston rod 75*b*. The bottom end of piston rod 75*b* is fixedly attached to stem 36, as for example, by a suitable threaded connection between the piston rod and the upper end portion of the stem. In this manner, a long compliant high pressure air spring is provided by the volume of gas underneath piston 75*a*. Thus, a low impedance coupling is afforded between the oscillator and the stem by virtue of the long dimension of the body of gas in the cylinder which provides a low spring rate along with tuning (in force change per unit displacement), even though the static load may be quite high.

Figure 11:
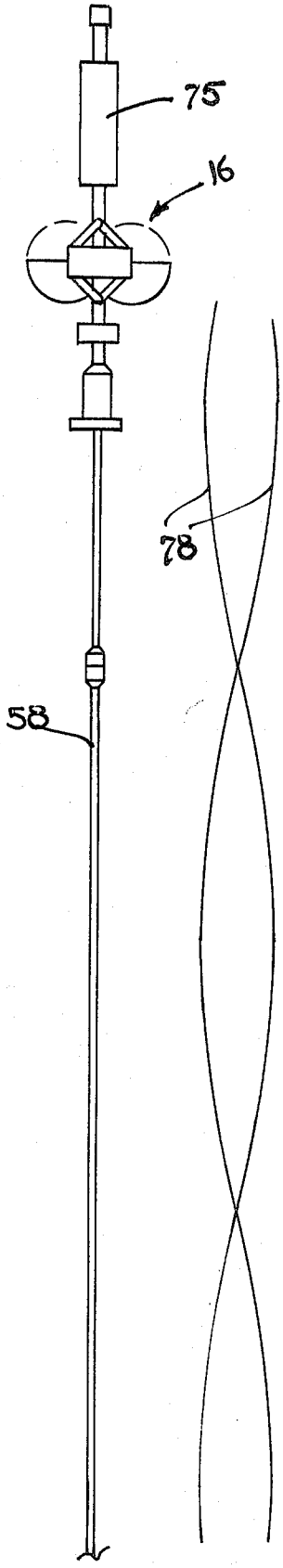
FIG. 11 is a schematic illustration of the second embodiment illustrating the low impedance coupling characteristics thereof.

Referring now to FIG. 11, the operation of the second embodiment of the invention is schematically illustrated. Wave forms 78 illustrate the standing wave pattern of the vibrational energy along drill string 58 in view of the effects of high pressure elongated air spring 75. As can be seen, an anti-node of the vibrational pattern appears at the top end of the drill string in view of the characteristics of the low impedance coupling provided.

While the invention has been described and illustrated in detail, it is to be clearly understood that this is intended by way of illustration and example only and is not to be taken by way of limitation, the spirit and scope of the invention being limited only by the terms of the following claims.

I claim:

1. A well servicing system for generating and feeding sonic energy down a pipe string suspended in a bore hole to a down hole work area comprising:

orbiting mass oscillator means for generating sonic energy, means for supporting said pipe string from a position above said bore hole, cylinder-piston assembly means for resiliently connecting the supporting means to the top end of the pipe string, means for providing pressurized fluid in said cylinder-piston assembly such that the fluid provides compliant loading for said piston, and means for coupling said oscillator to said pipe string at a point therealong proximate to and below said cylinder-piston assembly means to transmit said sonic energy from said oscillator to said pipe string such that a low acoustical impedance is presented to said energy transmission.

2. The system of claim 1 wherein the fluid in the cylinder-piston assembly is liquid and further including a gas accumulator, and means for coupling the liquid in the cylinder-piston assembly to the gas accumulator such that the accumulator provides compliant loading for said liquid.

3. The system of claim 1 wherein the means for coupling the sonic energy to the pipe string comprises a central stem interposed between the supporting means and the cylinder-piston assembly, the oscillator being connected directly to said central stem.

4. The system of claim 2 wherein the means for coupling the liquid in the cylinder-piston assembly to said accumulator comprises conduit means, the accumulator and conduit means forming a Helmholtz resonator with the compliance of the gas in the accumulator and the mass of the liquid in the conduit means having equal and opposite reactances at the frequency of the sonic energy.

5. The system of claims 1 or 4 wherein the orbiting mass oscillator comprises at least a pair of eccentric weights in the form of thin plates, and means for rotatably driving said weights in opposite directions to provide sonic energy to said pipe string in a vibration mode which is principally along the longitudinal axis thereof.

6. The system of claim 1 wherein the sonic frequency of said oscillator is at a resonance frequency of said pipe string.

7. The system of claim 3 wherein said cylinder-piston assembly is directly in line with said pipe string and said stem.

8. The system of claim 1 wherein the fluid is gas, said cylinder-piston assembly means comprising an elongated piston and an elongated cylinder having pressurized gas container therein.

* * * * *